US007794363B2

(12) United States Patent
Wang

(10) Patent No.: US 7,794,363 B2
(45) Date of Patent: Sep. 14, 2010

(54) REAR DRIVE TYPE ELECTRIC TREADMILL

(76) Inventor: Leao Wang, 13F, No. 23, Jiun-Ho Street, Beitun District, Taichung (TW) 406

( * ) Notice: Subject to any disclaimer, the term of this patent is extended or adjusted under 35 U.S.C. 154(b) by 101 days.

(21) Appl. No.: 12/198,101

(22) Filed: Aug. 25, 2008

(65) Prior Publication Data

US 2010/0048360 A1 Feb. 25, 2010

(51) Int. Cl.
*A63B 22/00* (2006.01)

(52) U.S. Cl. ..... 482/54; 482/51

(58) Field of Classification Search ..... 482/51, 482/54; 119/700

See application file for complete search history.

(56) References Cited

U.S. PATENT DOCUMENTS 6,926,644 B2 * 8/2005 Chen ..... 482/54
6,945,914 B1 * 9/2005 Cheng ..... 482/54
7,008,352 B2 * 3/2006 Grossi ..... 482/54
7,041,038 B2 * 5/2006 Smith et al. ..... 482/54
7,097,595 B1 * 8/2006 Wang ..... 482/54
7,192,388 B2 * 3/2007 Dalebout et al. ..... 482/54
7,285,075 B2 * 10/2007 Cutler et al. ..... 482/54
7,381,160 B2 * 6/2008 Lo ..... 482/54
7,540,828 B2 * 6/2009 Watterson et al. ..... 482/54
7,569,000 B2 * 8/2009 Wang ..... 482/54

* cited by examiner

*Primary Examiner*—Glenn Richman

(57) ABSTRACT

A rear drive type electric treadmill wherein a driving motor is disposed at the rear end of a platform for directly driving a rear drum that is matched with a front drum so as to bring a continuous moving belt in a continuous movement. In this way, the force to rotate the continuous moving belt comes from a position behind an operator, thereby eliminating the frustration of the continuous moving belt each time when a force acts thereon. Moreover, a horizontal portion of the base frame has a slide recess facing to the platform. The platform is provided with a projecting wheel set at both sides thereof in match of the slide recesses. In this way, the platform is easily lifted upward in a vertical position. Consequently, it is beneficial for the operator to fold-up and move the treadmill.

5 Claims, 5 Drawing Sheets

REAR DRIVE TYPE ELECTRIC TREADMILL

BACKGROUND OF THE INVENTION

1. Fields of the Invention

The invention relates to a rear drive type electric treadmill, and more particularly, to a structure that the force to rotate the continuous moving belt comes from a position behind an operator, thereby eliminating the frustration of the continuous moving belt each time when a force acts thereon. Meanwhile, the platform is easily lifted upward in a vertical position.

2. Description of the Related Art

As well-known, the conventional electric treadmills include a driving motor fitted at the front end of the continuous moving belt. Therefore, the force to rotate the continuous moving belt comes from a position before an operator. As a result, an instant and temporary stagnation of the continuous moving belt takes place since the continuous moving belt is subject to force suddenly (by the weight of the operator and the total gravity created during the exercise) each time when the operator treads on the continuous moving belt. However, the driving force of the driving motor is continuously supplied. Thus, an instant frustration of the continuous moving belt occurs until the instant treading gravity is lessened or disappears. In other words, the driving motor and the continuous moving belt can be smoothly operated after the driving force of the motor is greater than the instant external force. Consequently, the operator may feel the repeated instant frustration from the continuous moving belt during a rapid and continuous walking exercise on the treadmill.

The duration of the above-mentioned frustration is very short, and it may be ignored by the operator since he is accustomed thereto. After all, this is a serious mistake in view of the product design. Therefore, this requires further improvements.

SUMMARY OF THE INVENTION

A primary object of the invention is to provide a rear drive type electric treadmill wherein the force to rotate the continuous moving belt comes from a position behind an operator such that the driving force of the motor at the rear side can take away the force instantly acting on the continuous moving belt. In this way, the instant frustration may be removed and a smooth operation of the continuous moving belt is ensured.

According to the invention, a driving motor of a rear drive type electric treadmill is disposed at the rear end of a platform for directly driving a rear drum that is matched with a front drum so as to bring a continuous moving belt in a continuous movement. In this way, the force to rotate the continuous moving belt comes from a position behind an operator, thereby eliminating the frustration of the continuous moving belt each time when a force acts thereon. Moreover, a horizontal portion of a base frame has a slide recess facing to the platform. The platform is provided with a projecting wheel set at both sides thereof in match of the slide recesses. In this way, the platform is easily lifted upward in a vertical position. Consequently, it is beneficial for the operator to fold-up and move the treadmill.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

The present invention will now be described in more detail hereinafter with reference to the accompanying drawings that show a preferred embodiment of the invention.

Figure 1:
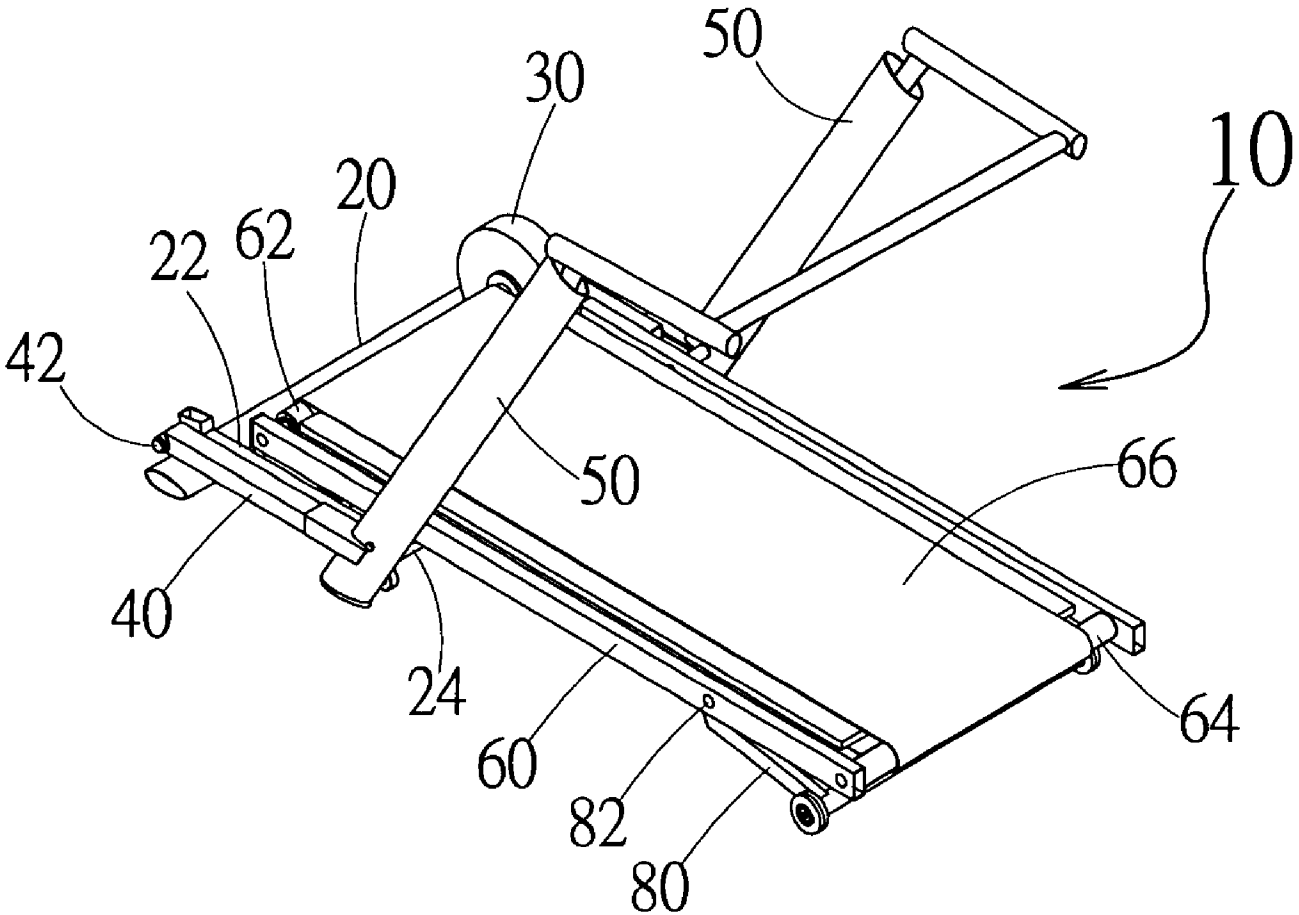
FIG. 1 is a perspective view of a preferred embodiment of the invention.
Figure 2:
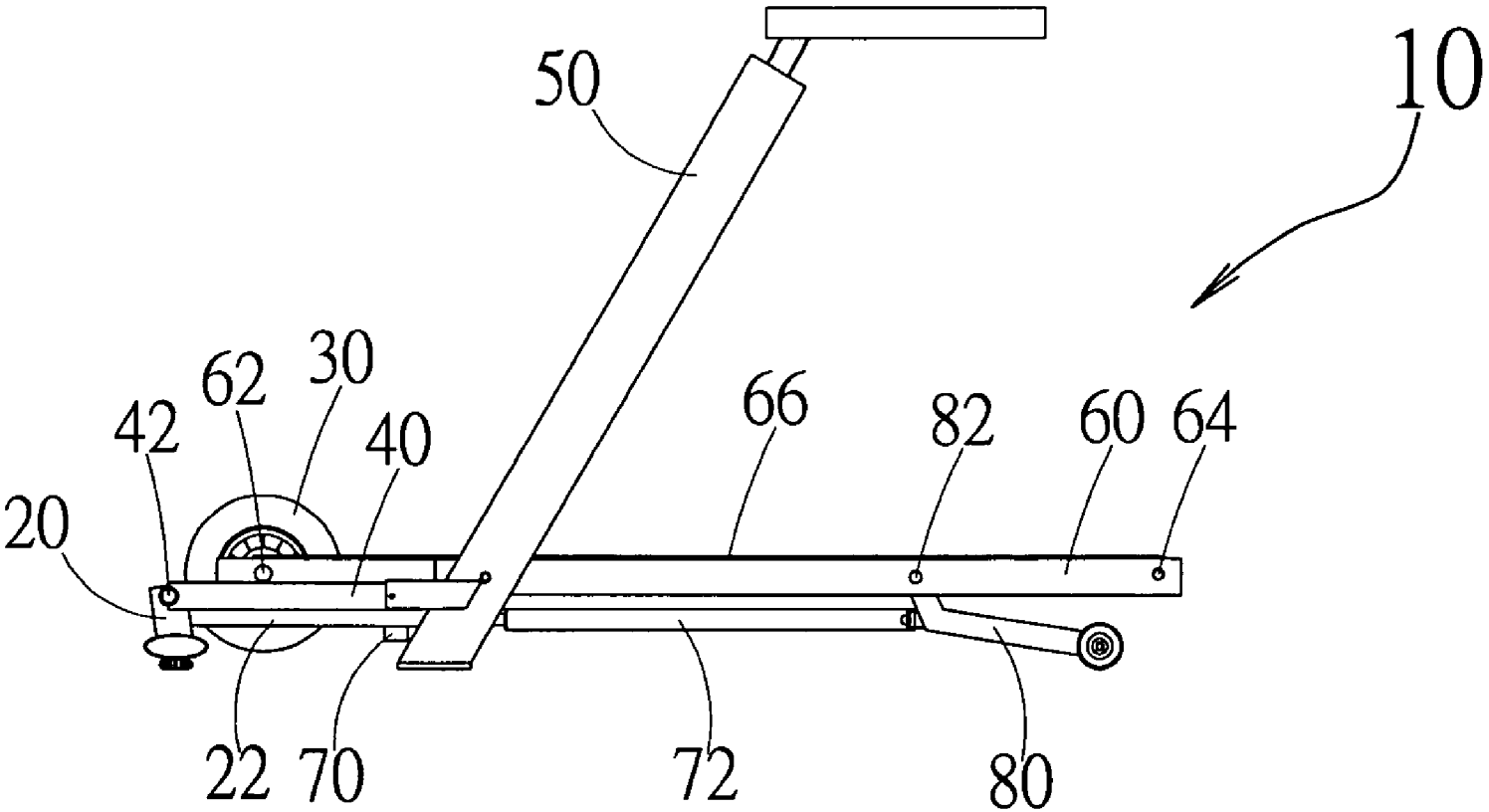
FIG. 2 is a side view of the preferred embodiment of the invention according to FIG. 1.

Referring to FIGS. 1 and 2, a treadmill 10 in accordance with of the invention includes a base frame 20, a driving motor 30, a handrail bracket 40, a handrail unit 50, a platform 60, a lifting motor 70, a lifting drive rod 72, and a front support 80. The driving motor 30 is disposed at the rear end of the platform 60 for directly driving a rear drum 62 that is matched with a front drum 64 so as to bring a continuous moving belt 66 in a continuous movement. In this way, the force to rotate the continuous moving belt 66 comes from a position behind an operator (not shown).

Figure 3:
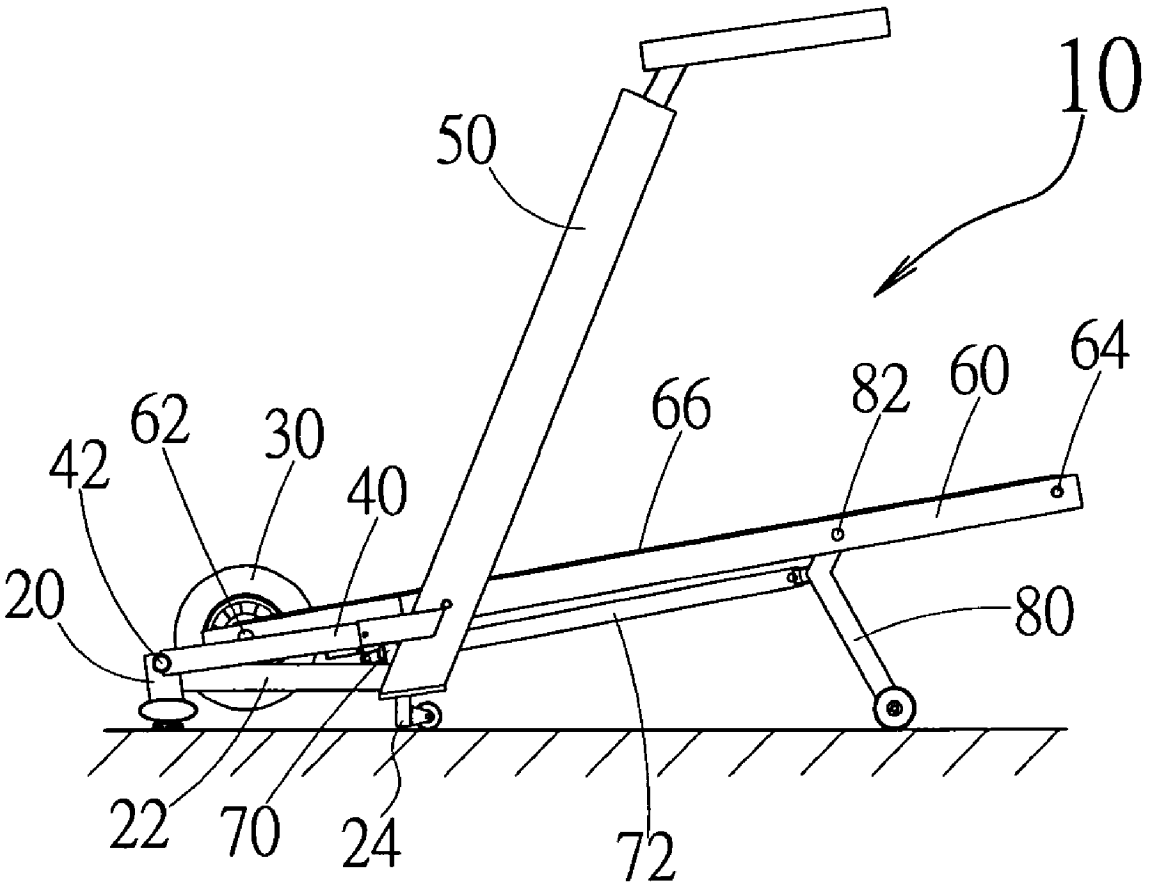
FIG. 3 is a schematic drawing of the lifting adjustment of the preferred embodiment of the invention according to FIG. 1.

As shown in FIGS. 2 and 3, the lifting motor 70 and the lifting drive rod 72 are installed at the bottom of the platform 60 in such a manner that the front support 80 pivotally disposed near the front end of the platform 60 is swiveled about a pivot 82, thereby achieving any adjustment of the supporting angle of the platform 60. In other words, an easy adjustment of the exercise slope is ensured.

Figure 4:
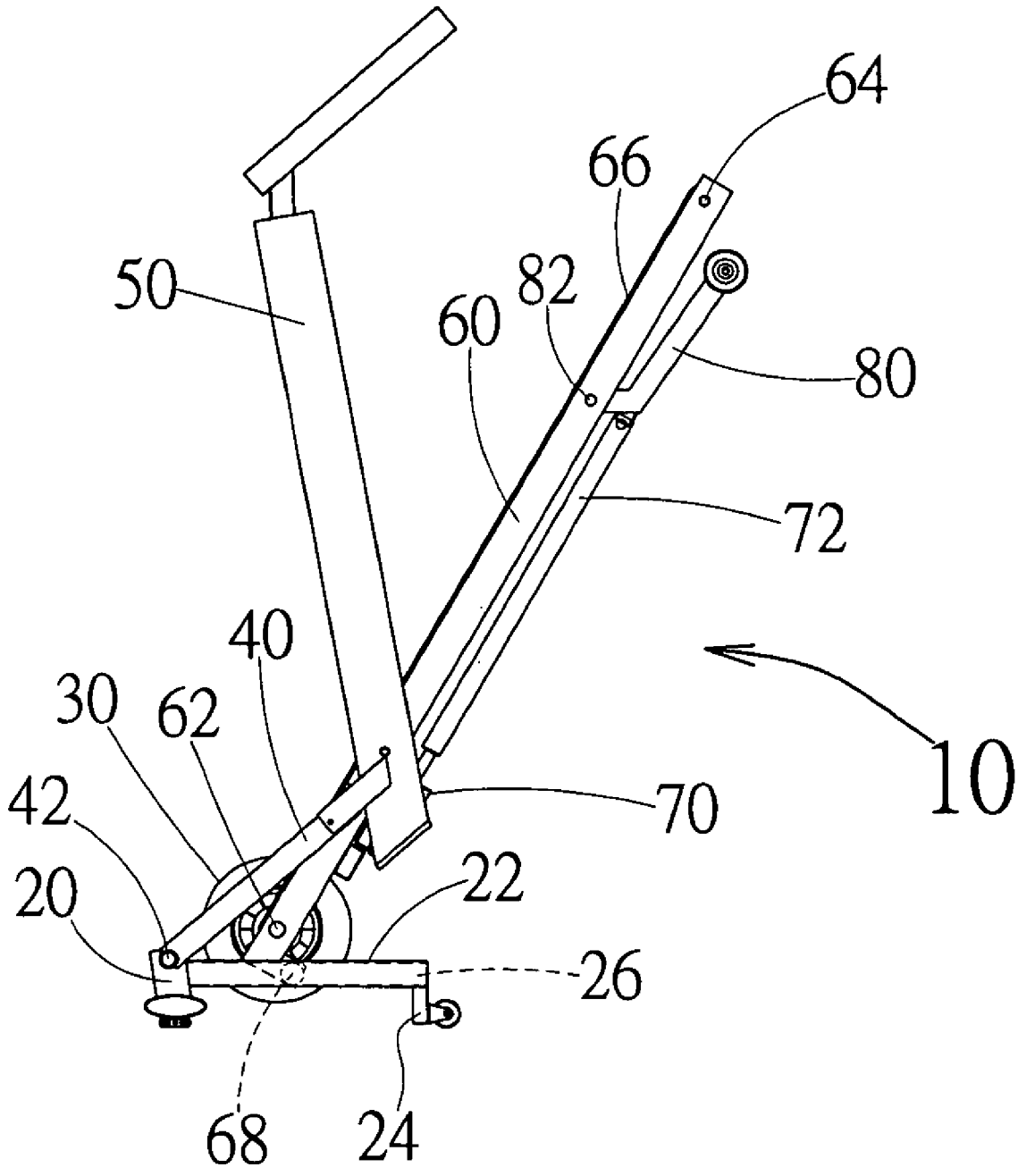
FIG. 4 is a schematic drawing of the preferred embodiment of the invention according to FIG. 1 in a folded-up position.
Figure 5:
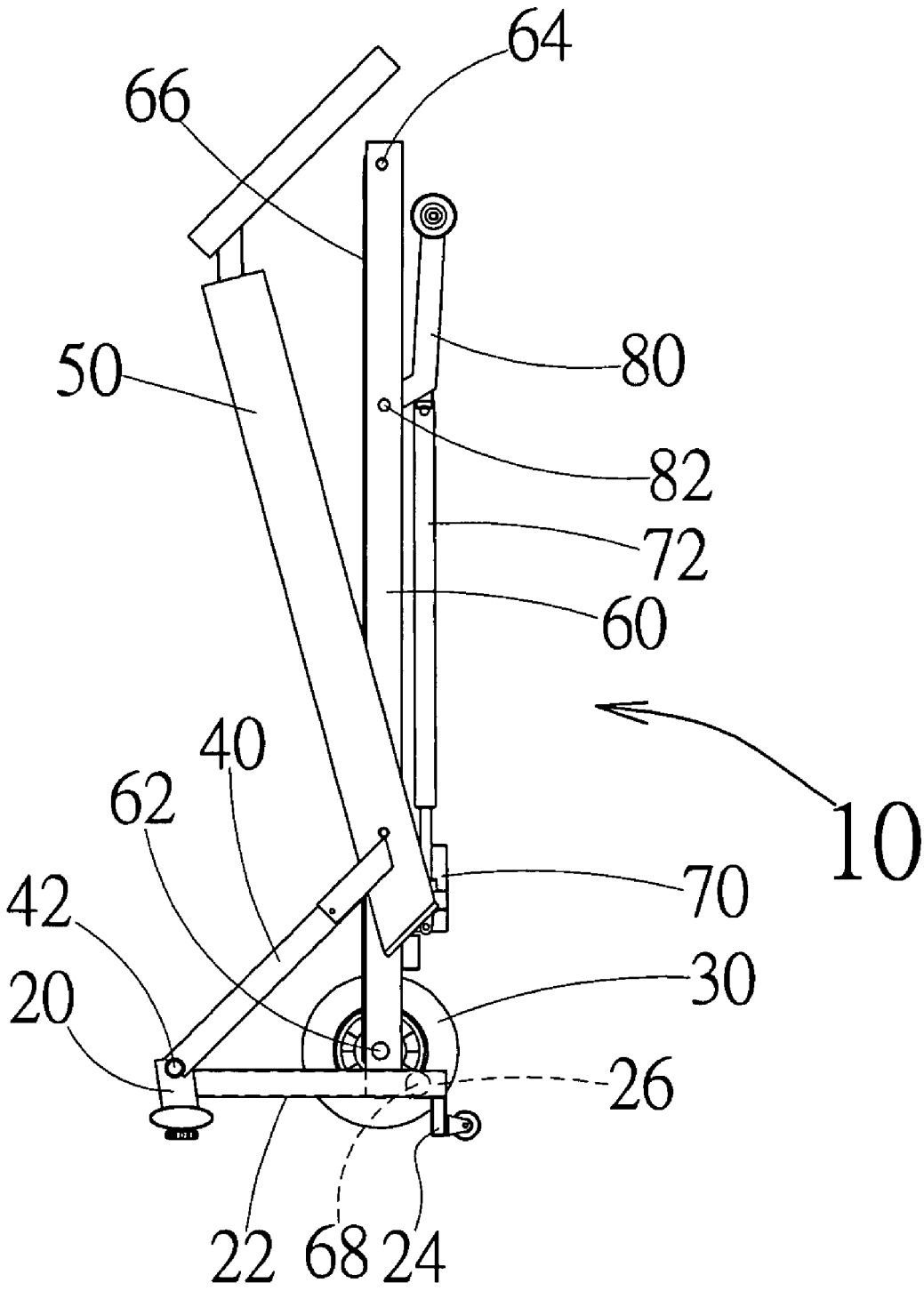
FIG. 5 is a side view of the preferred embodiment of the invention according to FIG. 4 that is folded up in a vertical position.

Referring to FIGS. 4 and 5, the base frame 20 includes a horizontal portion 22 and a secondary wheel support 24. The horizontal portion 22 has a slide recess 26 facing to the platform 60. The platform 60 is provided with a projecting wheel set 68 at both sides thereof. In folding the platform 60 upward, the platform 60 rotates on a shaft 42 between the handrail bracket 40 and the base frame 20 in such a way that the platform 60 is lifted by sliding the projecting wheel sets 68 in the slide recesses 26 until a vertical fold-up state is reached.

Of course, the handrail unit 50 and the platform 60 are pivotally secured as well. Thus, the swiveled movement of the platform 60 won't be affected.

In reality, the lifting motor 70 and the lifting drive rod 72 are optional elements. In taking the manufacturing cost into account, the treadmill of the invention is still applicable no matter if these two elements are present or not.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A rear drive type electric treadmill having a base frame, a driving motor, a handrail bracket, a handrail unit, a platform, a lifting motor, a lifting drive rod, and a front support, wherein the driving motor is disposed at the rear end of the platform for directly driving a rear drum that is matched with a front drum so as to bring a continuous moving belt in a continuous movement, wherein the base frame includes a horizontal portion and a secondary wheel support, and wherein the horizontal portion has a slide recess forming a track with an opening facing the platform, and wherein the platform is provided with a projecting wheel set at both sides thereof so that, in folding the platform upward, the platform rotates on a shaft between the handrail bracket and the base frame in such a way that the platform is lifted by sliding the projecting wheel sets in the slide recesses until a vertical fold-up state is reached.

2. The rear drive type electric treadmill as recited in claim 1, wherein the lifting motor and the lifting drive rod are installed at the bottom of the platform in such a manner that the front support pivotally disposed near the front end of the platform is swiveled about a pivot.

3. The rear drive type electric treadmill as recited in claim 1, wherein the slide recess extends along the horizontal portion.

4. A rear drive type electric treadmill having a base frame, a driving motor, a handrail bracket, a handrail unit, a platform, and a front support, wherein the base frame includes a horizontal portion and a secondary wheel support, and wherein the horizontal portion has a slide recess forming a track with an opening facing the platform, and wherein the platform is provided with a projecting wheel set at both sides thereof so that, in folding the platform upward, the platform rotates on a shaft between the handrail bracket and the base frame in such a way that the platform is lifted by sliding the projecting wheel sets in the slide recesses until a vertical fold-up state is reached.

5. The rear drive type electric treadmill as recited in claim 4, wherein the slide recess extends along the horizontal portion.

* * * * *